US010070746B1

(12) United States Patent
Cavazos

(10) Patent No.: US 10,070,746 B1
(45) Date of Patent: Sep. 11, 2018

(54) CLOTHES HANGER WITH STORAGE

(71) Applicant: Urbano Cavazos, Corpus Christi, TX (US)

(72) Inventor: Urbano Cavazos, Corpus Christi, TX (US)

( * ) Notice: Subject to any disclaimer, the term of this patent is extended or adjusted under 35 U.S.C. 154(b) by 0 days.

(21) Appl. No.: 15/053,159

(22) Filed: Feb. 25, 2016

(51) Int. Cl.
*A47G 25/28* (2006.01)
*B65D 43/16* (2006.01)
*B65D 85/18* (2006.01)

(52) U.S. Cl.
CPC ..... *A47G 25/28* (2013.01); *B65D 43/16* (2013.01); *B65D 85/18* (2013.01)

(58) Field of Classification Search
CPC ..... A47G 25/28; A47G 25/60; A47F 7/19; A47F 7/00; A47F 7/02; A47F 5/00; A47F 5/0006; A41D 27/22; A45C 11/16; A45C 13/02; B65D 43/16; B65D 85/18; E05B 69/00; E05B 69/003; E05B 69/006; E05B 69/02
USPC ..... D6/315, 328
See application file for complete search history.

(56) References Cited

U.S. PATENT DOCUMENTS 1,981,072 A * 11/1934 Roman ..... A47G 25/60 211/113
1,982,166 A * 11/1934 Hultquist ..... A47G 25/16 211/113
2,187,691 A * 1/1940 Newhouse ..... A47G 25/60 223/86
D167,041 S * 6/1952 Kandarian ..... D11/66
D239,041 S * 3/1976 Rubinstein ..... D6/318
D244,010 S * 4/1977 Young ..... D9/600
4,620,651 A * 11/1986 Spies ..... A47G 25/28 223/85
4,720,987 A * 1/1988 Moss ..... E05B 67/00 109/23
D327,582 S * 7/1992 Mathews ..... D6/328
5,427,230 A * 6/1995 Mattox ..... A47G 25/14 206/478
5,509,588 A * 4/1996 Kimball ..... A47G 25/54 206/286
6,161,686 A * 12/2000 Simon ..... A45C 11/16 206/6.1
(Continued)

*Primary Examiner* — Ismael Izaguirre
(74) *Attorney, Agent, or Firm* — Gulf Coast Intellectual Property Group

(57) ABSTRACT

A clothes hanger having a first storage compartment and a second storage compartment wherein the first storage compartment is integrally formed into the body of the clothes hanger. The first storage compartment further includes a first side storage compartment and a second side storage compartment. The first side storage compartment and second side storage compartments are configured within independent access doors. The clothes hanger is further configured with a hook portion that is configured to be surroundably secured and locked to a support rod. The first side compartment and the second side compartment further include interior volumes that are divided into a plurality of storage sections by internal walls. A protective case is provided for the first storage compartment and the second storage compartment. The second storage compartment is secured to the clothes hanger with support rods and wherein the second storage compartment is below the clothes hanger.

12 Claims, 3 Drawing Sheets

(56) References Cited

U.S. PATENT DOCUMENTS

| | | | | |
|---|---|---|---|---|
| 6,808,064 | B1 * | 10/2004 | Fanning | A47G 25/743<br>206/286 |
| 2010/0006608 | A1 * | 1/2010 | Domb | A47G 25/60<br>223/86 |

* cited by examiner

CLOTHES HANGER WITH STORAGE

FIELD OF THE INVENTION

The present invention relates generally to storage apparatus, more specifically but not by way of limitation a storage apparatus integrally formed with a clothes hanger wherein the storage apparatus is configured to retain a plurality of different objects.

BACKGROUND

Clothes hangers are well known in the art and have been utilized for decades to hang various clothing items such as but not limited to shirts and pants in a closet. As is known in the art, clothes hangers can be manufactured from various different materials such as but not limited to metal wire, plastic or wood. Conventional clothes hangers include a mounting loop configured to engage a rod or similar support structure and a body loop that is somewhat triangular in shape that is formed so as to provide support for a shirt or pair of pants when journaled through the mounting loop.

One problem with conventional hangers is they do not take advantage of the void in the body loop and the void in the body loop is typically unused. Conventional hangers leave the void empty which fails to utilize the space provided by the body loop structure and provide some additional functionality for the clothes hanger. Another issue with conventional clothes hangers is the inability for the clothes hanger to be locked to the support rod from which it is suspended. Conventional clothes hangers typically have a hook structure integrally formed with the body loop that is configured to engage a support rod. These conventional structures do not provide a means to lock the hanger in place so as to inhibit movement from the support structure unless by an individual who has possession of a key or similar item.

Accordingly, there is a need for a clothes hanger that is configured to provide storage for a plurality of different items within the void of the body loop by having an integrated storage compartment disposed therein and wherein the clothes hanger can be locked onto a support rod so as to inhibit the removal thereof.

SUMMARY OF THE INVENTION

It is the object of the present invention to provide a clothes hanger having a body loop wherein the body loop is configured to have a storage compartment disposed therein that is operable to store a plurality of items.

Another object of the present invention is to provide a clothes hanger having integrated storage that is configured to provide a hanging structure for an article of clothing wherein the integrated storage compartment is secured within the aperture of the body loop.

A further object of the present invention is to provide a clothes hanger with integrated storage wherein the storage compartment secured within the body loop of the hanger includes a first side storage compartment and a second side storage compartment having access doors provided for both.

Still another object of the present invention is to provide a clothes hanger having integrated storage within the body loop thereof wherein the integrated storage is provided as releasably secured to the body loop of the clothes hanger or integrally formed therewith.

An additional object of the present invention is to provide a clothes hanger having integrated storage formed within the body loop thereof wherein the clothes hanger includes an integrally formed hanging loop that is configured to be lockable so as to be secured to a support rod and inhibit removal therefrom.

Yet a further object of the present invention is to provide a clothes hanger that includes integral storage present in the body loop thereof that further includes a lower storage compartment that is suspendedly secured to the body of the clothes hanger.

Another object of the present invention is to provide a clothes hanger having integral storage formed in the body loop thereof wherein the first side storage compartment and second side storage compartment are configured with locks so as to inhibit access thereto.

An alternative object of the present invention is to provide a clothes hanger having integrated storage in the body loop thereof that further includes a bag operable to cover the body so as to conceal the integrated storage compartment.

Yet another object of the present invention is to provide a clothes hanger having integrated storage formed in the body loop thereof wherein the lower storage compartment is lockable and further includes a bag surroundably mounted thereto.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 2:
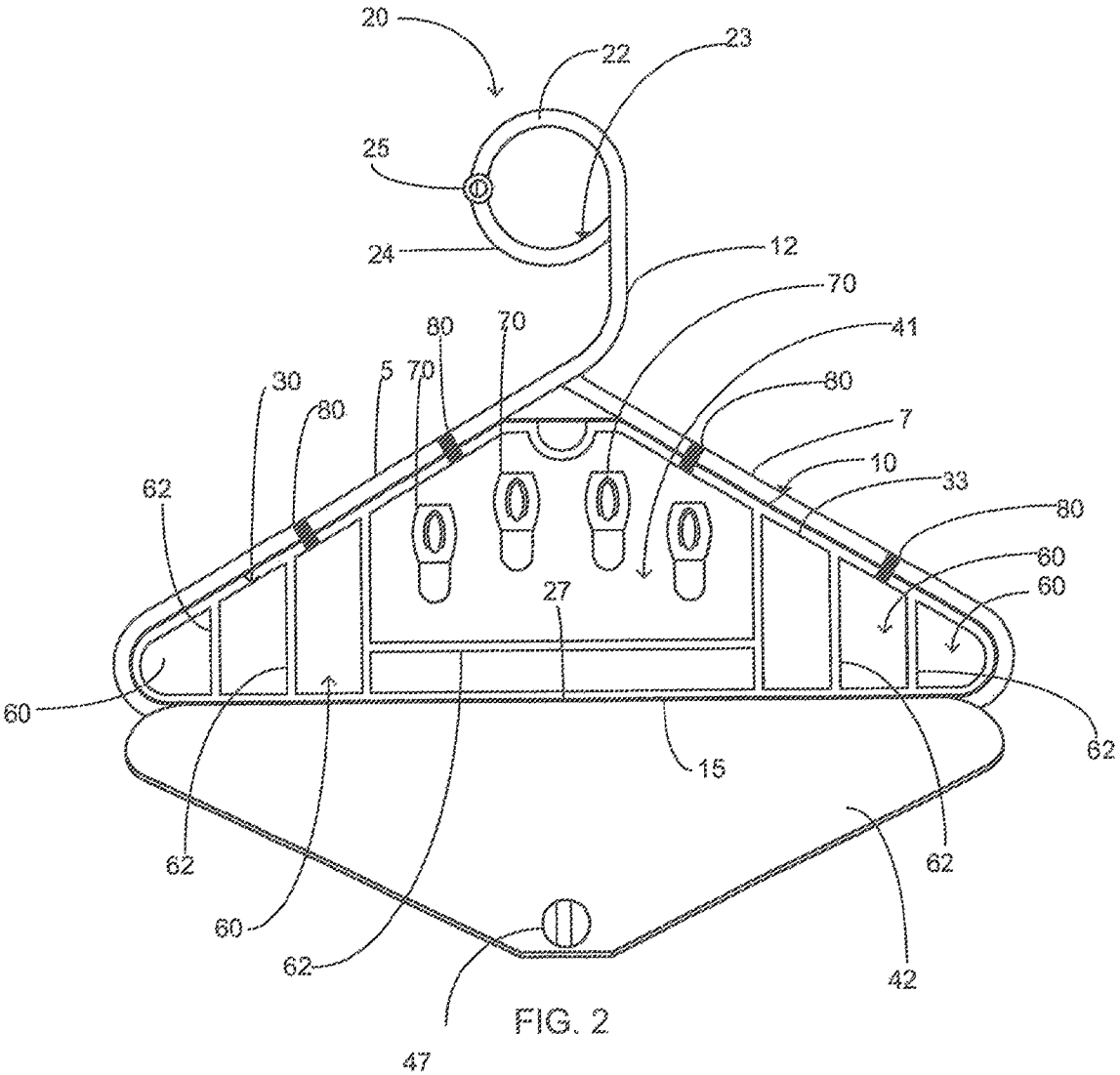
FIG. 2 is a side view of an embodiment of the present invention.

Referring now to the drawings submitted herewith, wherein various elements depicted therein are not necessarily drawn to scale and wherein through the views and figures like elements are referenced with identical reference numerals, there is illustrated a clothes hanger 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 1:
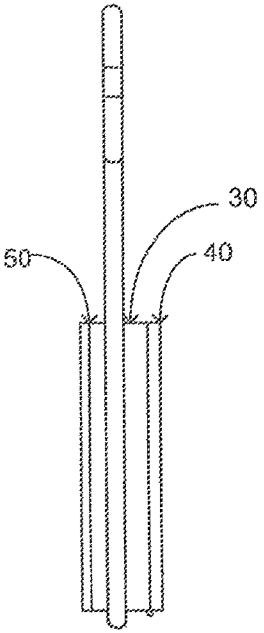
FIG. 1 is a end view of an embodiment of the present invention.

Referring in particular to FIGS. 1 and 2 the clothes hanger 100 further includes a peripheral support member 10 that is formed to create a loop shaped in a modified triangular shape. The peripheral support member 10 includes a first upper portion 5 and a second upper portion 7 that are angular in manner with respect to neck 12 and are operable to engage a portion of clothing such as but not limited to a shirt so as to provide suspension thereof ensuing being surroundably mounted to the peripheral support member 10. The peripheral support member 10 further includes an integral bottom member 15 that is integrally formed with the first upper portion 5 and second upper portion 7 forming the modified triangular shape of the clothes hanger 100. The peripheral support member 10 is manufactured from a suitable durable material such as but not limited to wood and is shaped so as to form a central void 3 within. It is contemplated within the scope of the present invention that the peripheral support member 10 could be formed so as to create alternate shapes of the clothes hanger 100 all having the central void 3. The neck 12 extends generally upward from the peripheral support member 10 and is integrally formed with hook portion 20. Hook portion 20 is formed so as to suspend the clothes hanger 100 from a suitable support structure such as but not limited to a rod. The hook portion 20 includes a first segment 22 and a second segment 24 that are hingedly coupled with locking hinge 25. The second segment 24 is hingedly movable so as to move intermediate a first position and a second position. FIG. 2 illustrates the second position wherein the second segment 24 is positioned so as to have end 23 adjacent neck 12 and wherein locking hinge 25 has been placed in a locked position so as to inhibit the second segment 24 from being moved to the first position without the a key (not illustrated herein) that is operable to engage the locking hinge 25. In its second position, the second segment 24 inhibits the removal of the clothes hanger 100 from a support rod. It is contemplated within the scope of the present invention that the locking hinge 25 could include a variety of different locking mechanism in order to achieve the desired objective stated herein. It is further contemplated within the scope of the present invention that the hinge 25 could be a conventional hinge without a lock and in conjunction therewith the second segment 24 would interface with a locking device disposed on the neck 12 so as to provide locking of the clothes hanger 100 to a support rod. Those skilled in the art will recognize that numerous types of locking mechanisms could be integrated into the neck 12 so as to provide locking of the second segment 24 thereto.

Releasably secured within the peripheral support member 10 is storage compartment 30. Storage compartment 30 is mateably shaped with the central void 3 that is formed by the peripheral support member 10. The storage compartment 30 is manufactured from suitable rigid materials such as but not limited to plastic or wood and substantially fills the central void 3. The storage compartment 30 includes a first side compartment 40 and a second side compartment 50 that are formed so as to be generally equal in width. The first side compartment 40 is illustrated in particular in FIG. 2 herein with the access door 42 shown in its open position so as to expose the interior volume 41. The storage compartment 30 includes contiguous outer wall 33 that is constructed of a suitable rigid material and defines the shape of the storage compartment 30 so as to be mateable with the central void 3. Disposed within the first side compartment 40 are a plurality of storage sections 60 that are operably divided by the internal walls 62. The storage sections 60 are sized so as to accommodate a variety of items therein such as but not limited to cuff links, necklaces or firearms. The internal walls 62 are manufactured from a suitable rigid material such as but limited to plastic or wood. While a particular quantity and configuration of the internal walls 62 has been illustrated herein forming storage sections 60 of a specific size and shape, it is contemplated within the scope of the present invention that the storage compartment 30 could be configured with no internal walls 62 so as to have one storage section 60 or with a plurality of internal walls 62 as illustrated herein in FIG. 2 forming a plurality of storage sections 60. A plurality of hooks 70 are further secured within at least one of the storage sections 60 so as to provide a means to hang items such as but not limited to bracelets and/or necklaces. While four hooks 70 are illustrated herein, it is contemplated within the scope of present invention that the first side compartment 40 could have no hooks 70 or more than four hooks 70. It should be understood within the scope of the present invention that the storage compartment 30 could be provided in a configuration such that the storage compartment is releasably secured to a conventional clothes hanger utilizing fasteners 80.

Access to the first side compartment 40 is provided by access door 42. Access door 42 is manufactured from a suitable rigid material and is hingedly mounted to the bottom 27 of the storage compartment 30 utilizing suitable fasteners such as but not limited to a piano hinge. The access door 42 has an open position, shown in FIG. 2 and a closed position (not particularly illustrated herein). The access door 42 includes lock 47 that is a conventional locking mechanism and operable to restrict access to the first side compartment 40 without a key or other similar item. Those skilled in the art will recognize that the lock 47 could be constructed in various different manners.

The storage compartment 30 further includes second side compartment 50 shown in end view of FIG. 1. The second side compartment 50 is identically constructed as first side compartment 40 illustrated and discussed herein. The alternative embodiments and configuration referenced herein for the first side compartment 40 equally apply to the second side compartment 50. Additionally, it is further contemplated within the scope of the present invention that the storage compartment 30 could be comprised of only the first side compartment 40 wherein the first side compartment 40 would have greater depth so as to accommodate objects therein of alternate size. It is contemplated within the scope of the present invention that the storage compartment 30 could be integrally formed with the peripheral support member 10 or be releasably secured thereto utilizing fasteners 80. In the latter embodiment, the storage compartment 30 could be sized and shaped so as to be mateably coupled with a conventional clothes hanger.

Figure 3:
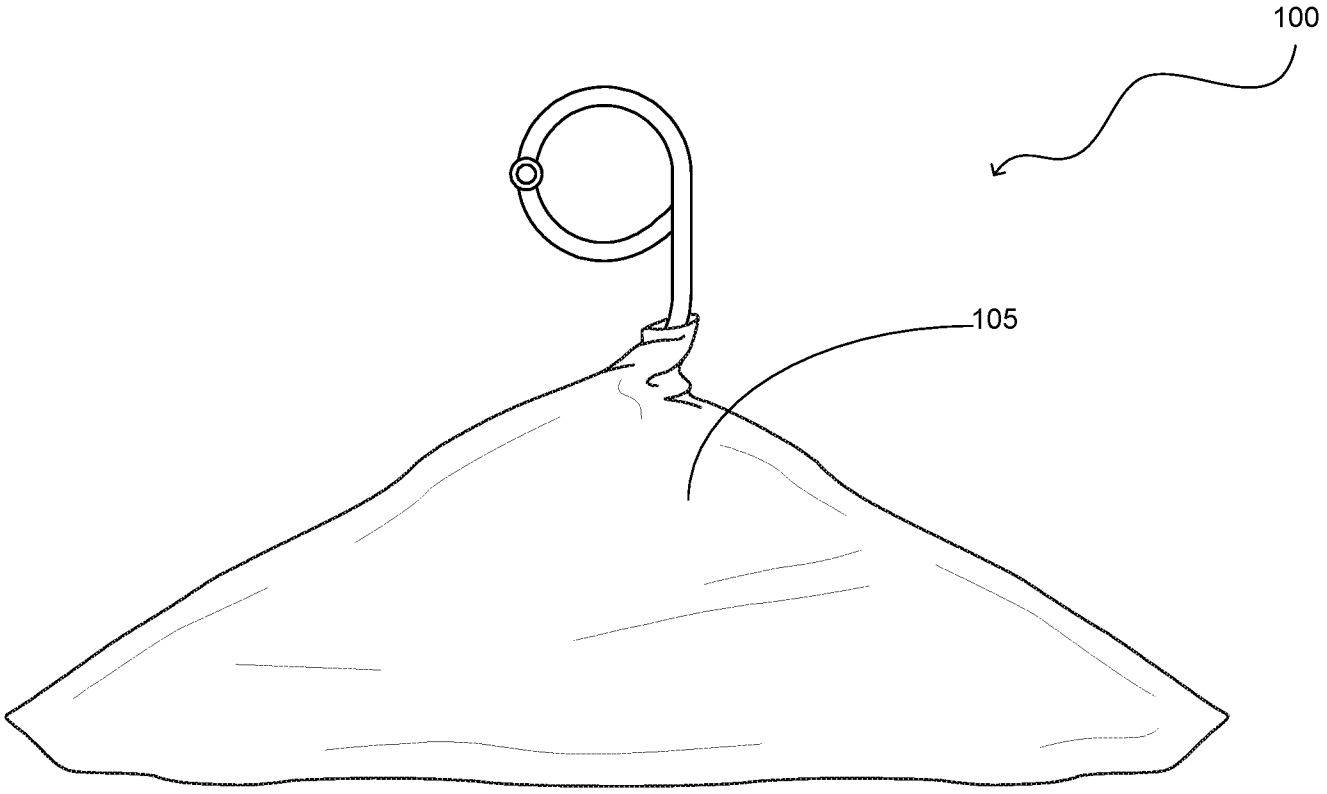
FIG. 3 is a side view of an embodiment of the present invention with a bag surroundably mounted thereto.

Illustrated in FIG. 3, the clothes hanger 100 is illustrated having protective case 105 surroundably mounted thereto. The protective case is manufactured from a solid soft material such as but not limited to nylon and is operable to provide a first function and a second function. The first provided function is to conceal the storage compartment 30 so as to inhibit an individual from being aware of its presence. A second function of the protective case is to provide a protective layer intermediate the clothes hanger 100 and an article of clothing suspended thereon so as to prevent any damage to the article of clothing. While not particularly illustrated herein, it is contemplated that the protective case 105 could be releasably secured to the clothes hanger 100 utilizing a zipper or other conventional fasteners.

Figure 4:
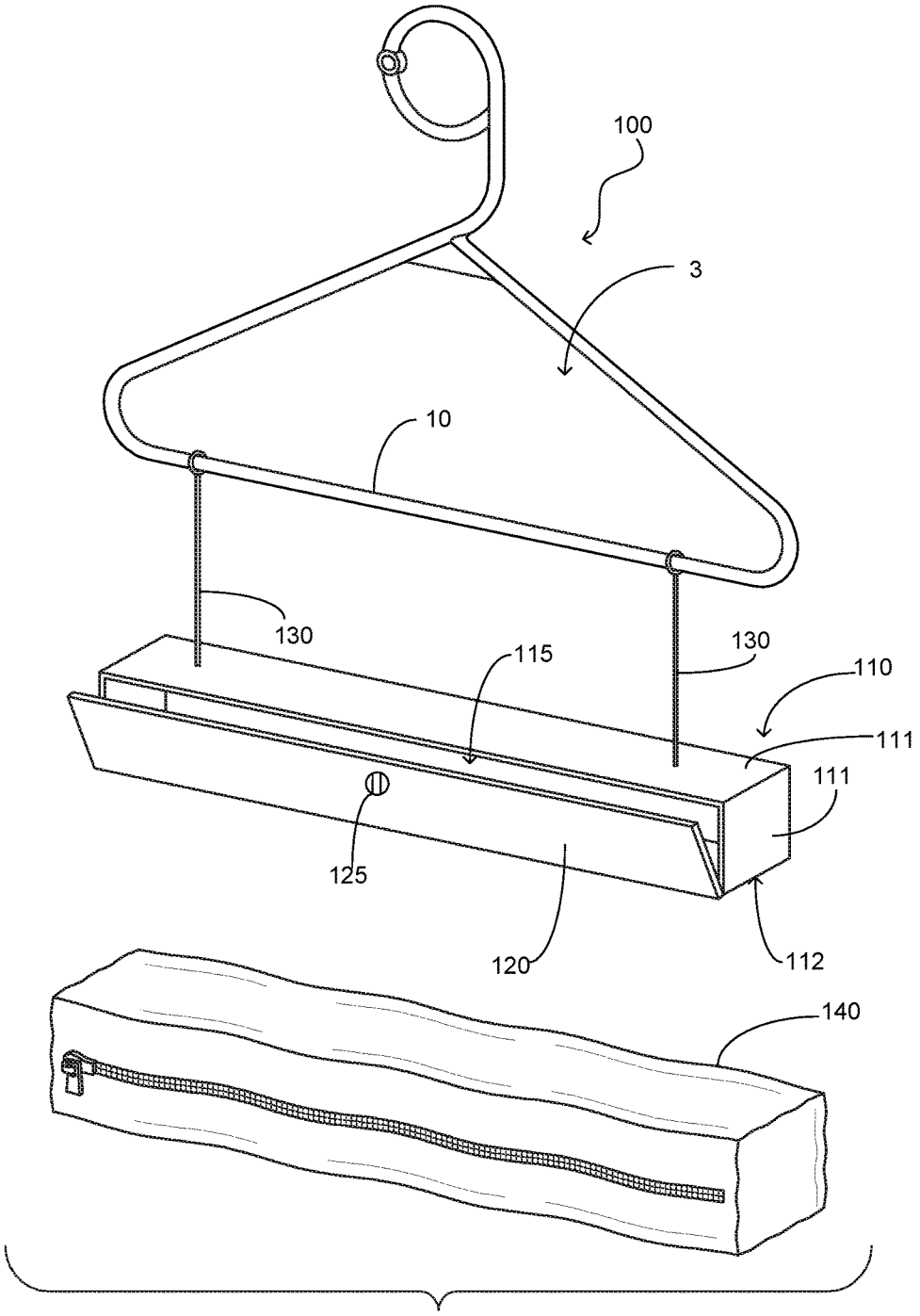
FIG. 4 is a perspective view of an embodiment of the present invention having the lower storage compartment secured thereto and further illustrating the bag for the lower storage compartment.

Referring now to FIG. 4, the clothes hanger 100 is illustrated herein having the lower storage compartment 110 secured thereto. The lower storage compartment 110 is formed with a plurality of walls 111 and a bottom 112 integrally formed to create interior volume 115. The lower storage compartment 110 is manufactured from a suitable rigid material such as but not limited to wood or plastic and is further operable to receive an article of clothing thereon such as but not limited to a pair of pants folded thereover. The lower storage compartment 110 includes hingedly secured access door 120 providing access to the interior volume 115 so as to dispose objects therein. The access door 120 further includes lock 125 that is operable to inhibit access to the interior volume 125. The lower storage compartment 110 is suspendedly mounted to the peripheral support member 10 utilizing support rods 130. It is contemplated within the scope of the present invention that the support rods 130 could be integrally secured to the peripheral support member 10 or releasably secured thereto. The support rods 130 are manufactured from a suitable material such as but not limited to metal or wood. While the lower storage compartment 110 is illustrated herein as being rectangular in shape, it is contemplated within the scope of the present invention that the lower storage compartment 110 could be formed in alternate shapes. Furthermore, it is contemplated within the scope of the present invention that the lower storage compartment 110 could be configured with a second access door (not illustrated herein) so as to provide a user access to the interior volume 115 from both sides of the lower storage compartment 110. Additionally, in the aforementioned configuration the interior volume 115 could include a dividing wall configured to provide separate internal storage compartments within the lower storage compartment 110.

Protective bag 140 is manufactured similarly to protective case 105 and is operable to provide the identical functions as discussed herein for the protective case 105.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A clothes hanger compartment configured to be releasably secured within a void of a conventional clothes hanger comprising:

a body, said body having an outer wall, said outer wall being of mateable shape to the void of a conventional clothes hanger, said outer wall defining the interior volume of the body, said body having a first side and a second side, said body having a bottom, said body having a first side compartment, said first side compartment having an interior volume being configured to receive and store an object therein, wherein said first side compartment further includes a plurality of internal walls, said internal walls dividing said first side storage compartment into a plurality of storage sections, said first side of said body having an access door, said access door being hingedly secured to said bottom, said access door configured to provide access to the interior volume of said first side compartment, said first side compartment configured to be approximately half of the interior volume of the body;

a second side compartment, said second side compartment being within the interior volume of said body, said second side compartment being opposite the first side compartment, said second side compartment having an interior volume configured to receive at least one object therein, wherein said second side compartment further includes an access door, said access door providing access to the interior volume of said second side compartment, wherein said second side compartment further includes a plurality of internal walls, said internal walls dividing said second side storage compartment into a plurality of storage sections;

a protective case, said protective case being manufactured from a soft flexible material, said protective case being configured to be surroundably mounted to the conventional clothes hanger so as to substantially cover the clothes hanger compartment; and a plurality of fasteners, said plurality of fasteners secured to the exterior surface of said body, said plurality of fasteners configured to releasably secure said body to the conventional clothes hanger.

2. The clothes hanger compartment as recited in claim 1, wherein said access door of said first side compartment and said access door of said second side compartment are configured to be lockable.

3. A clothes hanger having an integrated storage compartment comprising:

a peripheral support member, said peripheral support member being formed in a modified loop shape having a central void, said peripheral support member having a neck portion integrally formed therewith, said peripheral support member having a hook portion contiguously formed with said neck portion, said hook portion configured to releasbly engage a support rod so as to suspend the clothes hanger therefrom;

a storage compartment, said storage compartment having an outer wall and a bottom, said storage compartment being disposed within said central void, said storage compartment having an interior volume configured to receive an object therein, said storage compartment having an access door hingedly secured to said bottom, said access door configured to provide access to said interior volume, wherein said storage compartment is divided into a first side compartment and a second side compartment, said first side compartments and said second side compartments having an interior volume, said first side compartment and said second side compartment being generally equal in size, wherein said first side compartment and said second side compartment have independent respective access doors providing access to the interior volumes thereof; and wherein the storage compartment is releasably secured to the peripheral support member and wherein said first side storage compartment further includes a plurality of internal walls, said internal walls dividing said first side storage compartment into a plurality of storage sections.

4. The clothes hanger as recited in claim 3, wherein said second side compartment further includes a plurality of internal walls, said internal walls dividing said second side storage compartment into a plurality of storage sections.

5. The clothes hanger as recited in claim 4, wherein said hook portion is further comprised of a first section and a second section, said first section and said second section hingedly secured, said first section and said second section configured to surroundably mount a support rod, said first section and said second section having a locking hinge intermediate thereto.

6. The clothes hanger as recited in claim 5, and further including a protective case, said protective case being manufactured from a soft flexible material, said protective case being configured to be surroundably mounted to the conventional clothes hanger so as to substantially cover the clothes hanger.

7. A clothes hanger having a first storage compartment and a second storage compartment comprising:

a peripheral support member, said peripheral support member being formed in a modified loop shape having a central void, said peripheral support member having a bottom portion, said peripheral support member having a neck portion integrally formed therewith, said peripheral support member having a hook portion contiguously formed with said neck portion, said hook portion configured to releasbly engage a support rod so as to suspend the clothes hanger therefrom;

a first storage compartment, said first storage compartment having an outer wall and a bottom, said first storage compartment being disposed within said central void, said first storage compartment having an interior volume configured to receive an object therein;

a second storage compartment, said second storage compartment being suspendedly mounted from the peripheral support member, said second storage compartment secured to a pair of support rods extending downward from said bottom of said peripheral support member, said second storage compartment having a plurality of walls and being rectangular in shape, said second storage compartment having an lockable access door providing access the interior volume thereof; and wherein the first storage compartment is further configured to have a first side storage compartment and a second side storage compartment.

8. The clothes hanger as recited in claim 7, wherein said first side compartment and said second side compartment have independent respective access doors providing access to the interior volumes thereof.

9. The clothes hanger as recited in claim 8, wherein said second side compartment further includes a plurality of internal walls, said internal walls dividing said second side storage compartment into a plurality of storage sections.

10. The clothes hanger as recited in claim 9, wherein said first side storage compartment further includes a plurality of internal walls, said internal walls dividing said first side storage compartment into a plurality of storage sections.

11. The clothes hanger as recited in claim 10, wherein said hook portion is further comprised of a first section and a second section, said first section and said second section hingedly secured, said first section and said second section configured to surroundably mount a support rod, said first section and said second section having a locking hinge intermediate thereto.

12. The clothes hanger as recited in claim 11, and further including a first protective case and a second protective case, said first protective case being configured to be surroundably mounted to the first storage compartment, said second protective case being surroundably mounted to said second storage compartment.

* * * * *